US005275524A

United States Patent [19]

Ishiwata

[11] Patent Number: 5,275,524

[45] Date of Patent: Jan. 4, 1994

[54] APPARATUS FOR CUTTING AND REMOVING PACKAGE MATERIAL

[75] Inventor: Yoshiyuki Ishiwata, Tokyo, Japan

[73] Assignee: Kirin Beer Kabushiki Kaisha, Tokyo, Japan

[21] Appl. No.: 921,057

[22] Filed: Jul. 29, 1992

[30] Foreign Application Priority Data

Jul. 30, 1991 [JP] Japan ..... 3-212823

[51] Int. Cl.[5] ..... B65B 69/00

[52] U.S. Cl. ..... 414/412; 83/402; 53/381.2

[58] Field of Search ..... 414/412, 403, 411; 53/381.2, 492; 83/22, 402

[56] References Cited

U.S. PATENT DOCUMENTS

| | | | |
|---|---|---|---|
| 3,884,010 | 5/1975 | Bardo et al. | 414/412 X |
| 4,158,417 | 6/1979 | Inove | 414/412 |
| 4,285,625 | 8/1981 | Yamada | 414/412 |
| 4,580,938 | 4/1986 | Mojden et al. | 414/412 X |
| 4,696,615 | 9/1987 | Ettischer et al. | 414/412 X |
| 4,938,649 | 7/1990 | ter Horst et al. | 414/412 |
| 4,995,771 | 2/1991 | Sedgeley et al. | 414/412 |
| 4,997,329 | 3/1991 | Hanamoto et al. | 414/412 |

FOREIGN PATENT DOCUMENTS

| | | |
|---|---|---|
| 2360805 | 6/1975 | Fed. Rep. of Germany . |
| 9002112 | 7/1991 | Fed. Rep. of Germany . |
| 2214483 | 9/1989 | United Kingdom . |

*Primary Examiner*—Michael S. Huppert
*Assistant Examiner*—James T. Eller, Jr.
*Attorney, Agent, or Firm*—Oblon, Spivak, McClelland, Maier & Neustadt

[57] ABSTRACT

A detecting device detects whether a package material has been removed from a packaged object by a package removing device. A discharging device is disposed adjacent to the package removing device, for discharging the packaged object from which the package material has not been removed as detected by the detecting device. A delivering device delivers the unpackaged object in which the package material has been removed, from the removing device to a next processing station. In the event that the detecting device does not detect the removal of the package material from the packaged object within a predetermined period of time from the start of operation of the removing device, the discharging device discharges the packaged object from the removing device into the discharge chute.

5 Claims, 13 Drawing Sheets

APPARATUS FOR CUTTING AND REMOVING PACKAGE MATERIAL

BACKGROUND OF THE INVENTION

1. Field of the Invention

The present invention relates to an apparatus for cutting and removing a package material from a packaged object, and more particularly to an apparatus for cutting and removing a sheet-like package material from a packaged object, and feeding the unpackaged object to a next processing station.

2. Description of the Prior Art

Ends to be attached to open-top cans such as beer cans, soft drink cans, or the like are superimposed in a cylindrical stack, wrapped by a package material, and delivered to a can making process. In the can making process, the package material is removed from the cylindrical stack of can ends, and one of the ends, at a time, is supplied to an open-top can which has been filled with a content such as beverage. Then, the end is placed over the open top of the cylindrical can and attached thereto by seaming.

Japanese Patent Application No. 63-322608 (Japanese Laid-Open Patent Publication No. 02-166034) discloses an apparatus for cutting and removing a package material from a packaged cylindrical object such as a cylindrical stack of can ends. The disclosed apparatus comprises a suction device for forming, under vacuum, a loop-like slackened portion of the package material in the longitudinal direction of the packaged cylindrical object, and a cutter for cutting open the slackened portion, and a package removing unit for removing the package material from the packaged object. The can ends which have been unpackaged are then transferred, one at a time, to a delivery device, and supplied to a seamer.

The disclosed apparatus also has a sensor positioned at the package removing unit for detecting when the package material is removed from the packaged object. In the event that the package material is not removed due, for example, to a package opening failure as detected by the sensor, the apparatus is shut off, and a suitable action is taken to cut open and remove the package material, thus restoring the apparatus. Since the seamer is continuing the seaming process during the apparatus shutdown, the seamer will also have to be shut off when all the can ends present in the transfer path between the apparatus and the seamer and also all the can ends stocked in the apparatus are used up.

There has also been developed a package cutting and removing apparatus equipped with a can end accumulator for accumulating can ends unpackaged from a plurality of packaged can stacks, the can end accumulator being positioned adjacent to a package removing unit. This package cutting and removing apparatus is also disadvantageous in that a seamer coupled thereto must be shut off when all the unpackaged can ends stocked in the can end accumulator are consumed. Further, storing unpackaged can ends in the can end accumulator is not preferable from a sanitary standpoint as the stored can ends are exposed to surrounding conditions.

Any of the above conventional apparatus are also problematic in that in the event of a package removal failure, the apparatus cannot quickly be restored to their normal operation as it takes a long period of time for a packaged object to travel from the inlet of the apparatus to a position for cutting open the package material of the packaged object.

SUMMARY OF THE INVENTION

It is an object of the present invention to provide an apparatus for cutting and removing a package material from a packaged object, which can operate, in the event that the package material cannot be removed from the packaged object due to a package cutting open failure at a package removing unit, to quickly discharge the packaged object without a shutdown, and to supply a new packaged object for cutting open and the removal of the package material thereof.

According to the present invention, there is provided an apparatus for cutting open and removing a sheet-like package material from an elongated packaged object, the apparatus comprising: means for feeding the packaged object in a longitudinal direction thereof; means for creating vacuum condition which is disposed along the packaged object feeding path and provided with a suction opening, the vacuum creating means drawing upwardly the package material of the packaged object to form a loop-like slackened portion of the package material extending in the longitudinal direction of the packaged object; a cutter disposed in the vacuum creating means near the suction opening and adapted to cut open the slackened portion of the package material; means for removing the cut-open package material from the packaged object; means for detecting whether the package material has been removed from the packaged object; means for delivering the unpackaged object in which the package material has been removed, from the removing means to a next processing station; means for discharging the packaged object from which the package material has not been removed as detected by the detecting means.

After the package material of the packaged object, typically a packaged stack of can ends, has been cut open by the cutter, the packaged object is fed into the removing means. The removing means removes the cut package material from the packaged object. The unpackaged object in which the package material has been removed is then discharged from the removing means. The delivery means then delivers the unpackaged object to a next processing station. In the event that the package material cannot be removed from the packaged object due to a failure, such a condition is detected by the detecting means, and the discharge means discharges the packaged object from the removing means to a discharge chute.

Immediately after the packaged object has been discharged into the discharge chute, a next packaged object is supplied to perform a next cutting operation, and the package material of the next packaged object is cut open and removed without shutting off the apparatus. Since the apparatus undergoes no shutdown in the event of a package opening or removal failure, the next processing station, e.g., a seamer, is not required to be shut off either.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

An apparatus for cutting and removing package material according to an embodiment of the present invention will be described below with reference to FIGS. 1 through 14.

Figure 1:
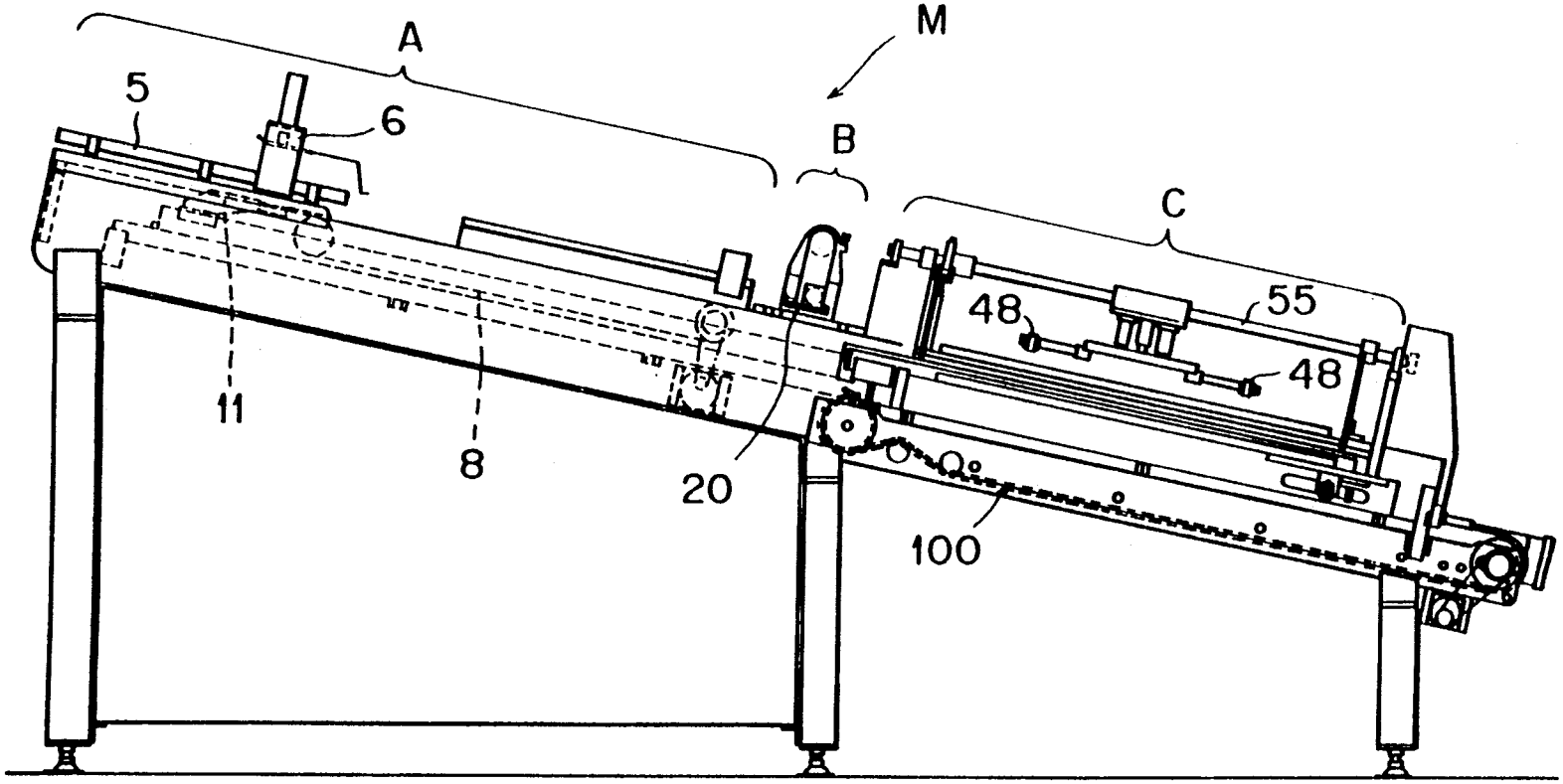
FIG. 1 is a front elevational view of apparatus for cutting and removing package material according to the present invention.
Figure 2:
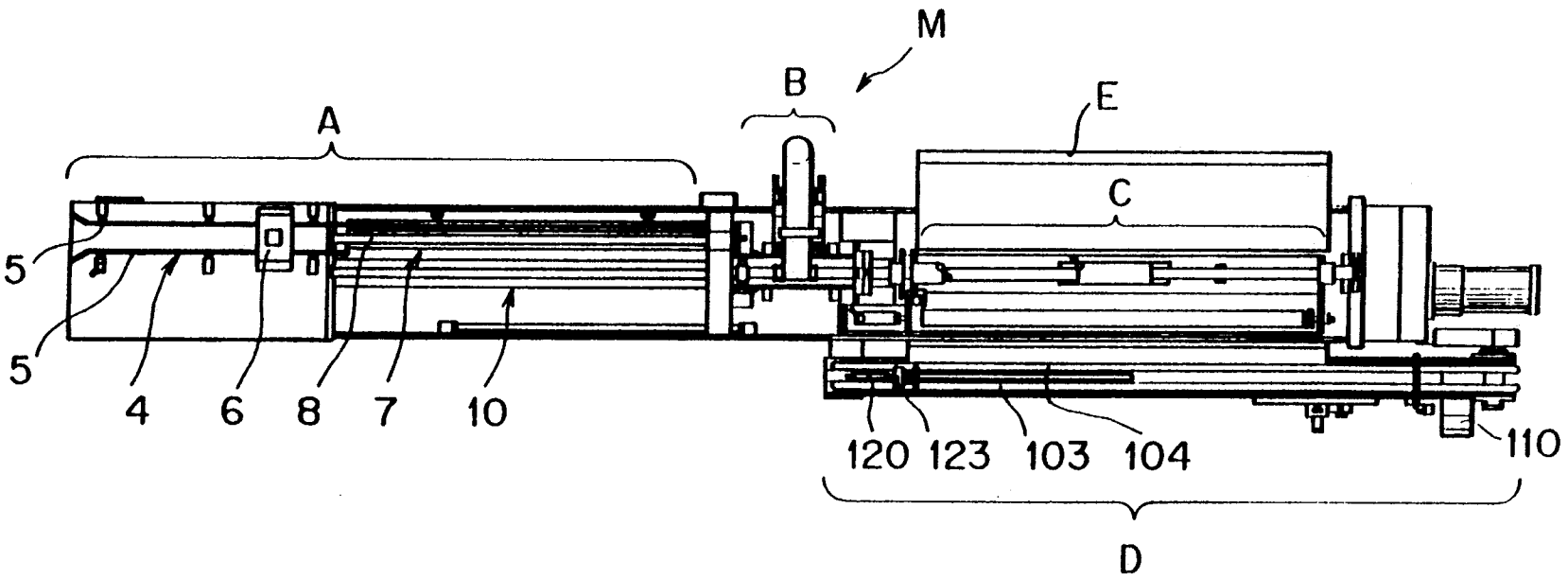
FIG. 2 is a plan view of the apparatus for cutting and removing package material.

FIGS. 1 and 2 show the whole structure of an apparatus for cutting and removing package material according to the present invention. The apparatus for cutting and removing package material, generally designated by the reference character M, cuts open and removes a sheet-like package material from a packaged cylindrical object, typically a stack of can ends, which moves from the left to the right in FIGS. I and 2. The apparatus M has a feed unit A for feeding the cylindrical packaged object, the feed unit A being disposed upstream with respect to the direction in which the cylindrical packaged object moves through the apparatus M. The apparatus M also includes a package cutting unit B disposed substantially centrally in the apparatus M, or downstream of the feed unit A, for cutting open a portion of the cylindrical packaged object, and a package removing unit C disposed downstream of the package cutting unit B, for removing the opened package material from the cylindrical packaged object.

As shown in FIG. 2, the apparatus M further includes a delivery mechanism D positioned alongside of the package removing unit C, for delivering an unpackaged cylindrical object, and a discharge chute E also positioned alongside of the package removing unit C, for discharging a packaged object from which the package material has not been removed due to a failure.

Figure 3:
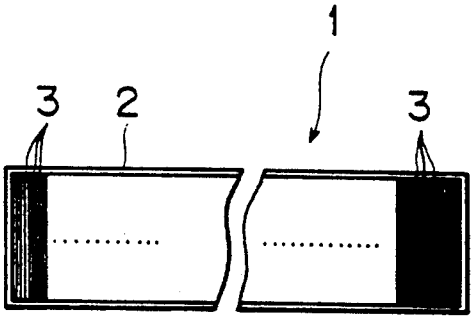
FIG. 3 is a fragmentary cross-sectional view of the apparatus for cutting and removing package material.

In the illustrated embodiment, as shown in FIG. 3, the packaged cylindrical object, generally designated by the reference numeral 1, comprises a cylindrical stack of can ends 3 wrapped by a sheet-like package material 2.

The feed unit A serves to move the packaged object 1 through the package cutting unit B to the package removing unit C. As shown in FIG. 2, the feed unit A comprises a supply section 4 located at the inlet of the apparatus M, a standby section 7 positioned directly downstream of the supply section 4, and a feed section 10 composed of a movable unit disposed laterally of and adjacent to the standby section 7.

The supply section 4 comprises a pair of guide members 5 for placing thereon and guiding the package object to move therealong, and a stopper mechanism 6 located near the outlet end of the guide members 5. The stopper mechanism 6 is intermittently actuatable to supply the packaged object 1 supplied from a conveyor (not shown) positioned upstream of the supply section 4, intermittently to the standby section 7.

Figure 4:
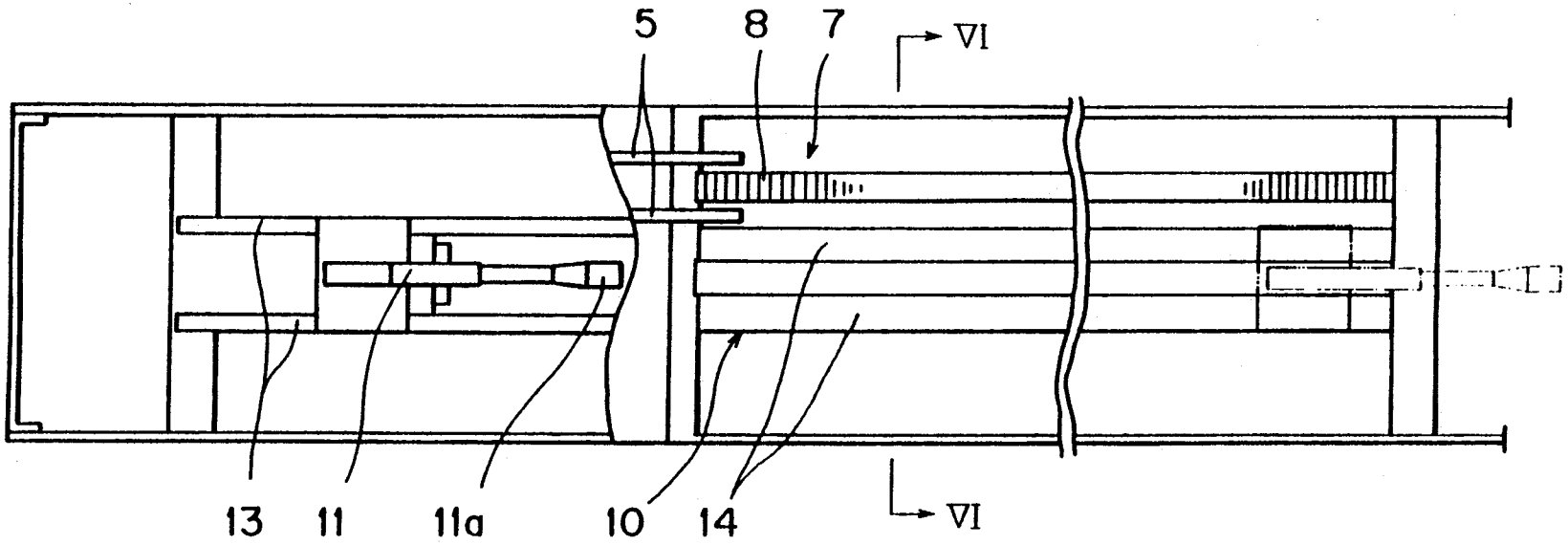
FIG. 4 is a plan view of a feed unit of the apparatus for cutting and removing package material.
Figure 5:
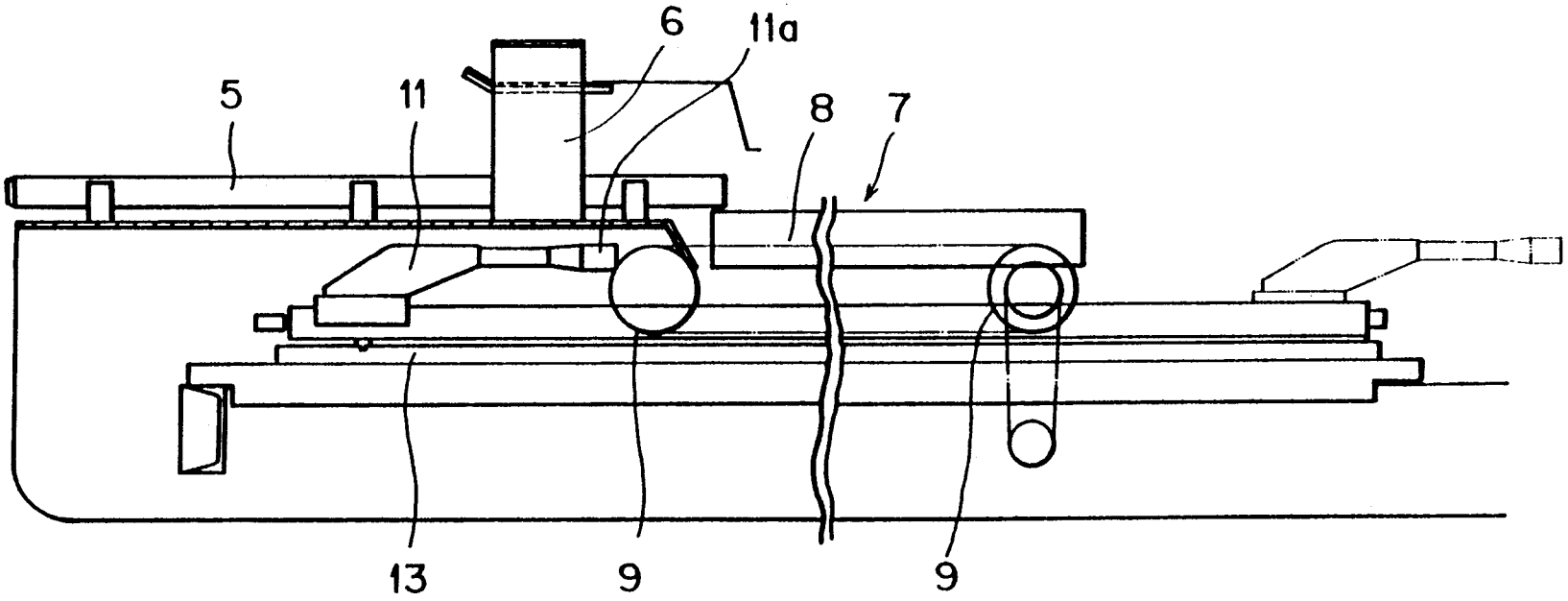
FIG. 5 is a cross-sectional view of the apparatus for cutting and removing package material.

As shown in FIGS. 4 and 5, the standby section 7 has an endless timing belt 8 and a pair of sprockets 9 around which the timing belt 8 is trained, one of the sprockets 9 being operatively coupled to a motor. The standby section 7 serves to feed the packaged object 1 from the supply section 4 to a standby position laterally of and adjacent to the feed section 10.

The feed section 10 comprises a pusher 11 and a pair of guide members 14. The pusher 11 pushes the trailing end of the packaged object 1 carried on and between the guide members 14 so that the packaged object 1 moves along the guide members 14.

Figure 6:
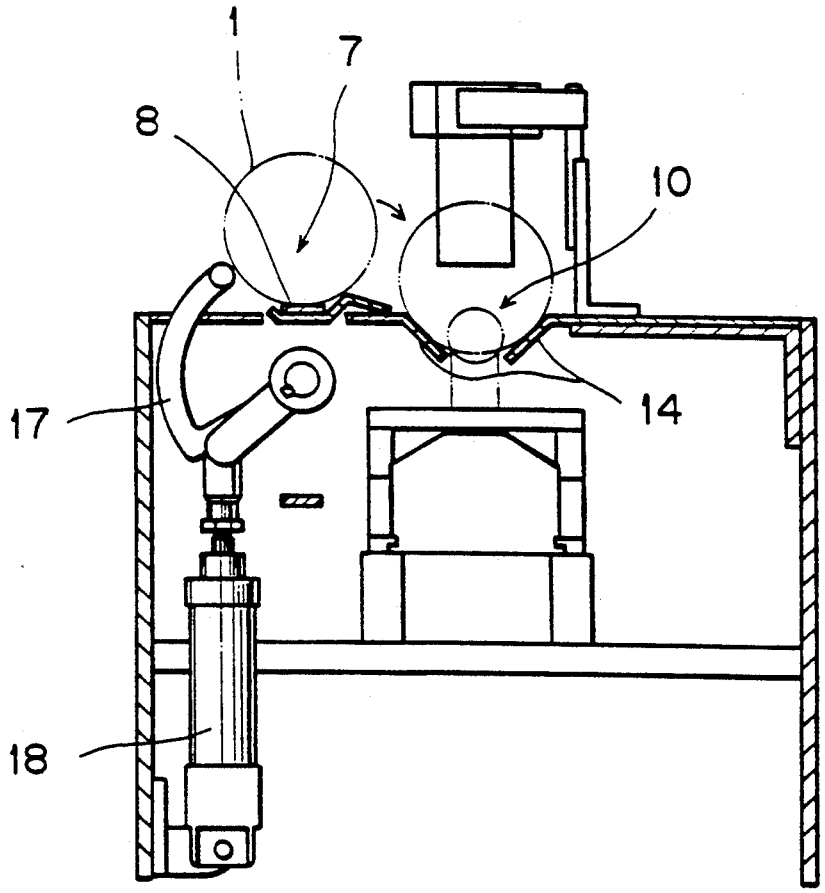
FIG. 6 is a cross-sectional view taken along line VI—VI of FIG. 4.

As shown in FIG. 6, the feed unit A also has a swing arm 17 coupled to an air cylinder 18 supported in a frame of the apparatus M. The swing arm 17 is disposed laterally of and adjacent to the standby section 7. When the swing arm 17 is angularly moved by the air cylinder 18, it pushes the packaged object 1 laterally from the standby position of the standby section 7 onto the guide members 14 of the feed section 10.

The pusher 11 is coupled to an air cylinder (not shown) and movably mounted on a pair of straight guide rails 13 (FIG. 4) supported in the frame. When the air cylinder is actuated, the pusher 11 is moved along the guide rails 13. When the pusher 11 is moved downstream, i.e., to the right in FIGS. 4 and 5, a pusher rod 11*a* on the distal end of the pusher 11 engages and pushes the trailing end of the packaged object 1 on the guide members 14, thereby moving the packaged object 1 downstream. The guide rails 13 extend from the feed unit A through the package cutting unit B into the package removing unit C. Therefore, the pusher 11 can push the packaged object 1 continuously from the feed unit A through the package cutting unit B into the package removing unit C, as described later on.

The packaged object 1 as it is pushed by the pusher 11 moves through the package cutting unit B which cuts open the package material 2.

Figure 7:
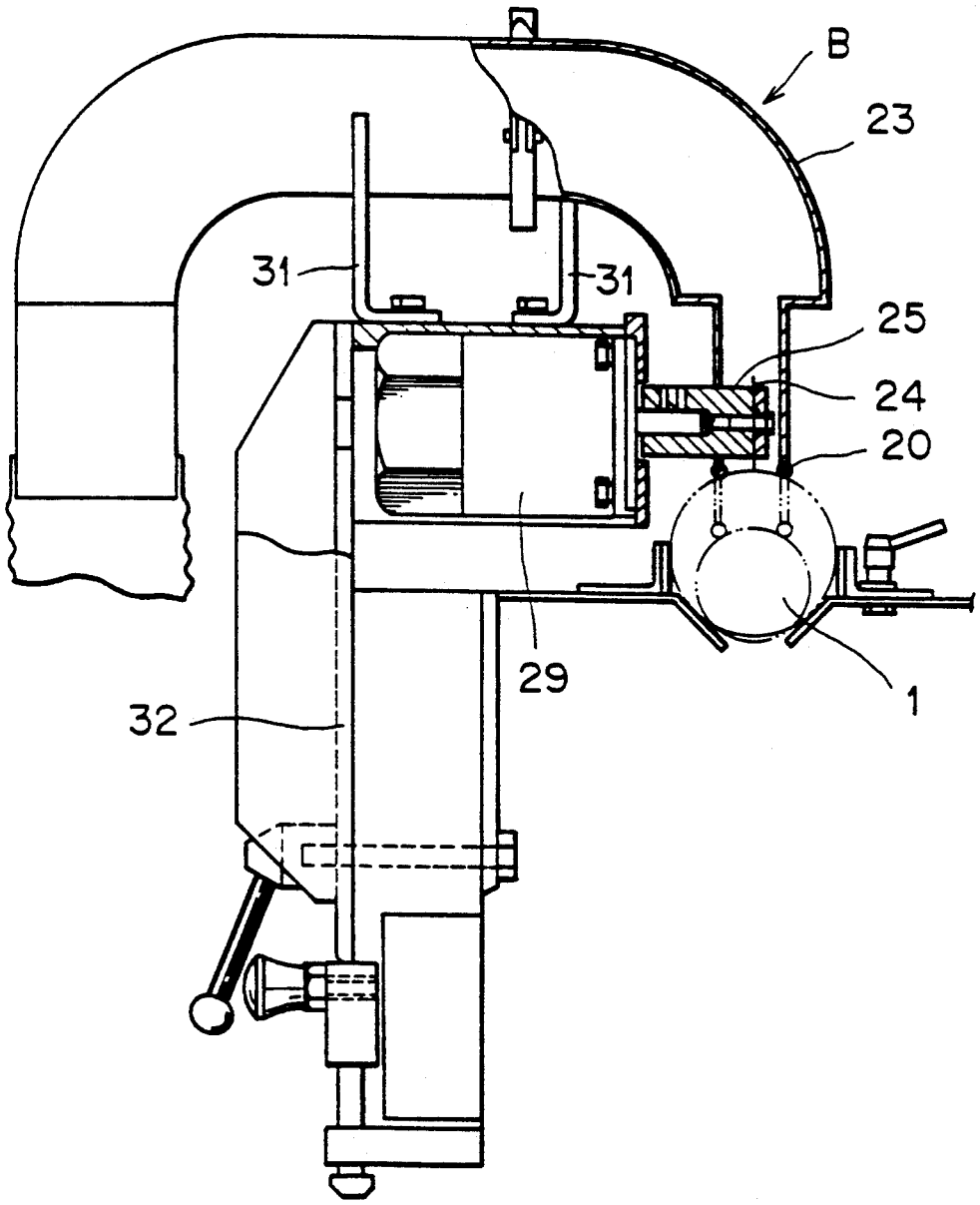
FIG. 7 is a cross-sectional view of a package cutting unit of the apparatus for cutting and removing package material.
Figure 8:
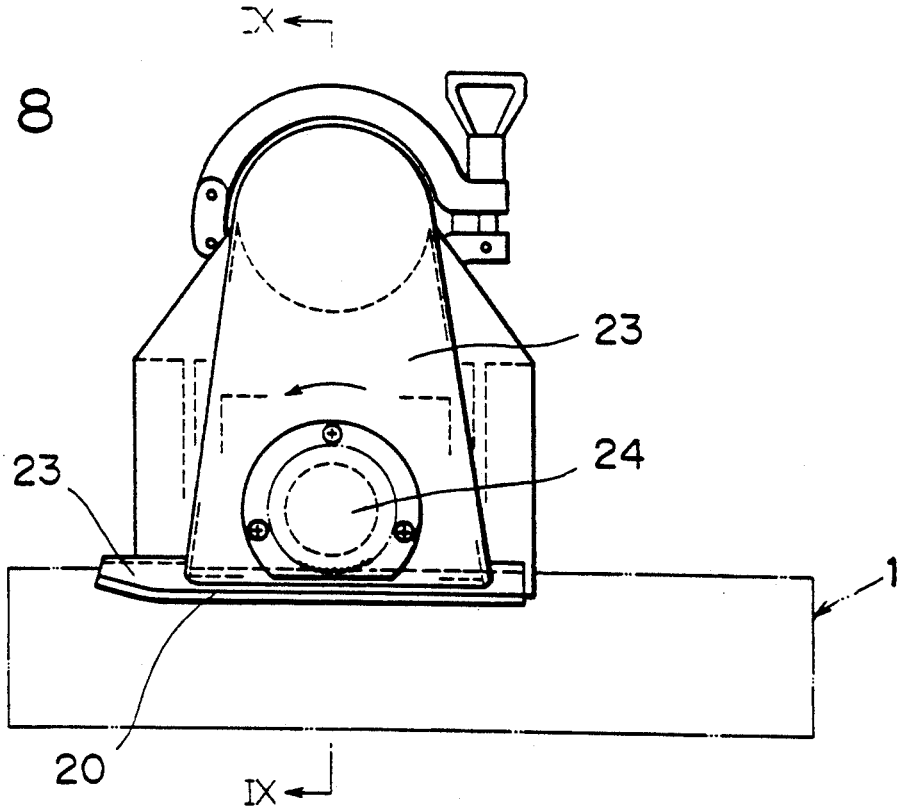
FIG. 8 is a front elevational view of the apparatus for cutting and removing package material.
Figure 9:
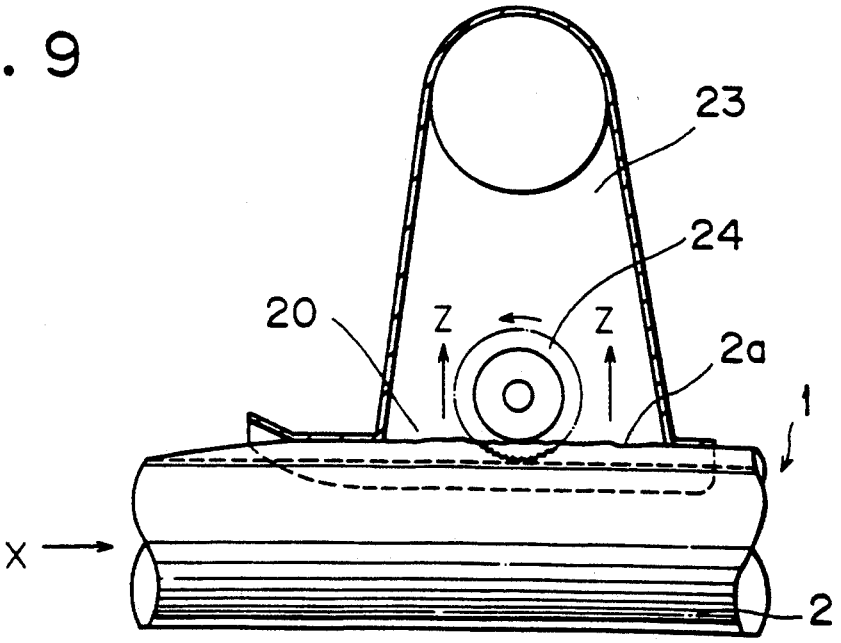
FIG. 9 is a cross-sectional view taken along line IX—IX of FIG. 8.

As shown in FIGS. 7 through 9, the package cutting unit B has a suction duct 23 connected to a vacuum source (not shown), such as an air blower, and having a suction port 20 opening downwardly for contacting and drawing an upper surface of the packaged object 1 to form an upwardly slackened portion which extends longitudinally of the package material 2 when the vacuum source is actuated. The package cutting unit B also includes a cutter 24 adjacent to the suction port 20, for cutting open the upwardly slackened portion of the package material 2, and a height adjusting mechanism for adjusting the height, or vertical position, of the cutter 24.

More specifically, the suction port 20 is positioned such that the upper surface of the packaged object 1 as it is pushed by the pusher 11 to move through the package cutting unit B will be located near the suction port 20 directly therebelow. When the vacuum source is actuated, a vacuum is created in the suction duct 23 to draw upwardly the package material 2 of the packaged object 1 while the packaged object 1 is moving through the package cutting unit B. The cutter 24, which is of a disc shape, is coupled to a motor 29, and hence is rotatable about its own axis.

As shown in FIG. 7, the motor 29 is fixed to a movable attachment base 32. The suction duct 23 is also fixedly mounted on the movable attachment base 32 by a pair of support arms 31. The movable attachment base 32 is vertically movable so that the cutter 24 and the suction port 20 are also vertically movable. Therefore, the cutter 24 and the suction port 20 can be adjusted in height to adapt themselves to packaged objects 1 of different diameters.

Next, operation of the package cutting unit B will be described briefly. When the packaged object 1 moves in the direction indicated by the arrow X in FIG. 9 into a position directly below the suction port 20, the package material 2 of the packaged object 1 is subjected to upward forces indicated by the arrows Z under a vacuum developed in the suction duct 23, and is pulled upwardly, thus forming an upwardly slackened portion 2*a* in the upper region of the packaged object 1.

As the packaged object I is continuously pushed downstream by the pusher 11, the upwardly slackened portion 2*a* is continuously formed in the longitudinal direction of the packaged object 1. At this time, the upwardly slackened portion 2*a* is in contact with the circumferential cutting edge of the cutter 24 which is positioned above the packaged object 1. When the cutter 24 is rotated by the motor 29, it cuts open the package material 2. Since the packaged object 1 is continuously moving downstream, the cutter 24 forms an axially elongate slit in the upwardly slackened portion 2*a* of the package material 2.

The packaged object 1 with its package material 2 thus cut open is then fed to the package removing unit C by the pusher 11. In the package removing unit C, the package material 2 is removed from the packaged object 1.

Figure 10:
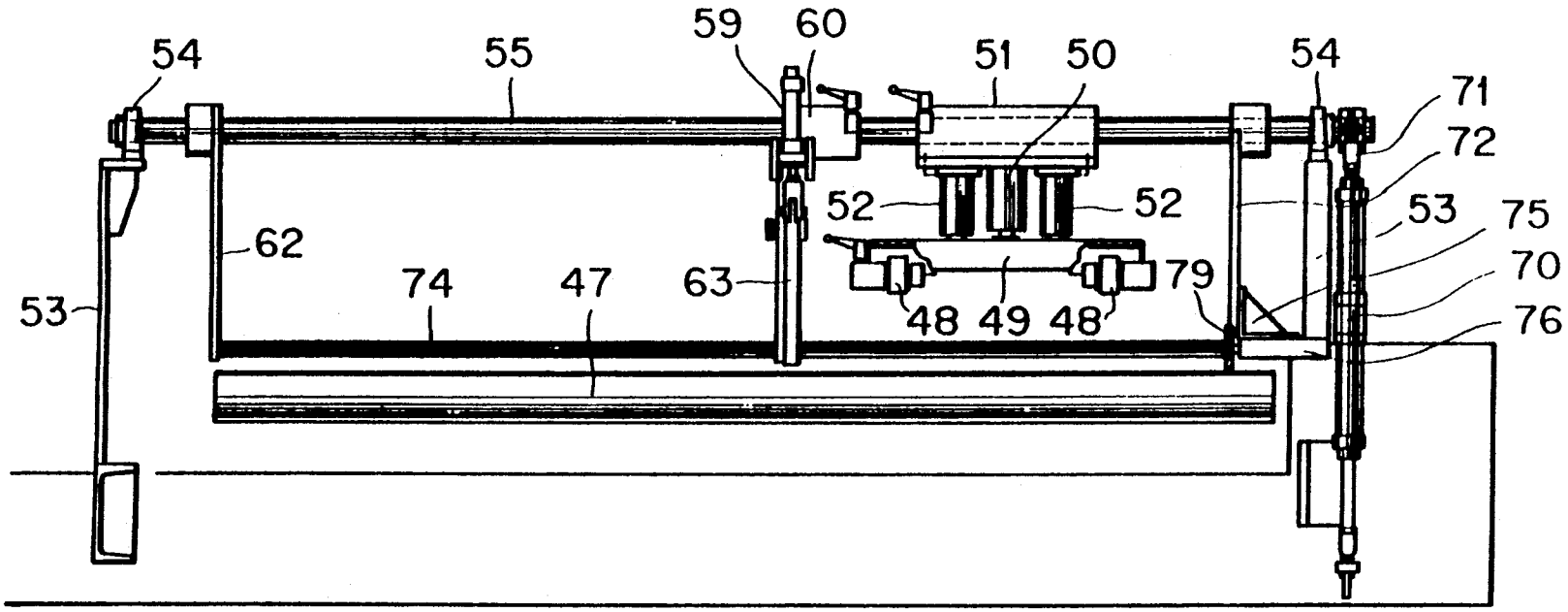
FIG. 10 is a front elevational view of a package removing unit of the apparatus for cutting and removing package material.
Figure 11:
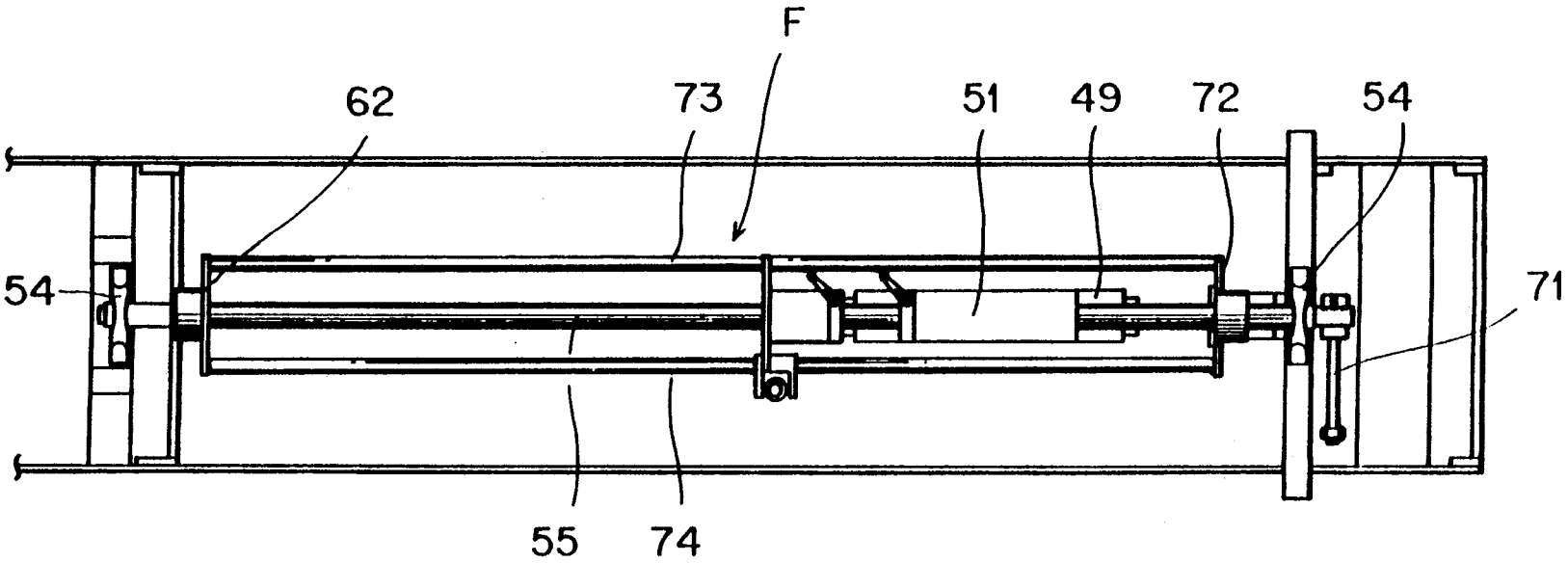
FIG. 11 is a plan view of the apparatus for cutting and removing package material.
Figure 12:
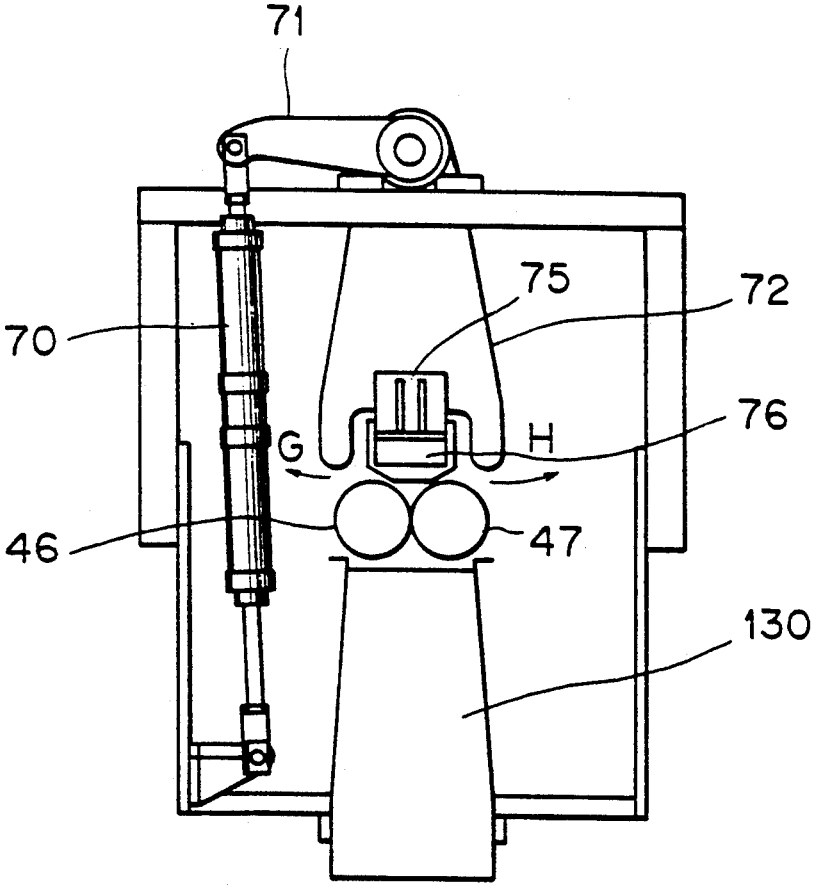
FIG. 12 is a side elevational view of the apparatus for cutting and removing package material.

As shown in FIGS. 10 through 12, the package removing unit C has a pair of parallel elongate stripper rollers 46, 47 whose outer circumferential surfaces are held against each other and which are rotatable in opposite directions. In the package removing unit C, the packaged object 1 with the package material 2 that has been cut open by the cutter 24 is placed on the stripper rollers 46, 47, which are rotated in the opposite directions to remove the package material 2 from the packaged object 1.

The package removing unit C also has a pair of holder rollers 48 for holding the packaged object 1 down on the stripper rollers 46, 47 to allow the package material 2 to be stripped reliably by the stripper rollers 46, 47. The holder rollers 48 are rotatably supported on a bracket 49 which is coupled to and suspended from a horizontal movable sleeve 51 by an air cylinder 50. Therefore, the bracket 49 is vertically movable by the air cylinder 50. The bracket 49 is guided in its vertical movement by a pair of slide bushings 52 disposed between the bracket 49 and the sleeve 51 and positioned one on each side of the air cylinder 50. The movable sleeve 51 is supported on and fitted over a horizontal main shaft 55 extending parallel to the stripper rollers 46, 47. The movable sleeve 51 can be moved along the main shaft 55 to vary the horizontal position of the holder rollers 48 depending on the length of the packaged object 1 on the stripper rollers 46, 47. The main shaft 55 is rotatably supported by bearings 54 on upper ends of a pair of support members 53, 53 fixed to the frame of the apparatus M.

As shown in FIG. 10, a bracket 60 is supported on the main shaft 55, and a downwardly directed air cylinder 59 is mounted on the bracket 60. The air cylinder 59 has a piston rod to which an upper end of a shutter plate 63 is attached.

Figure 13:
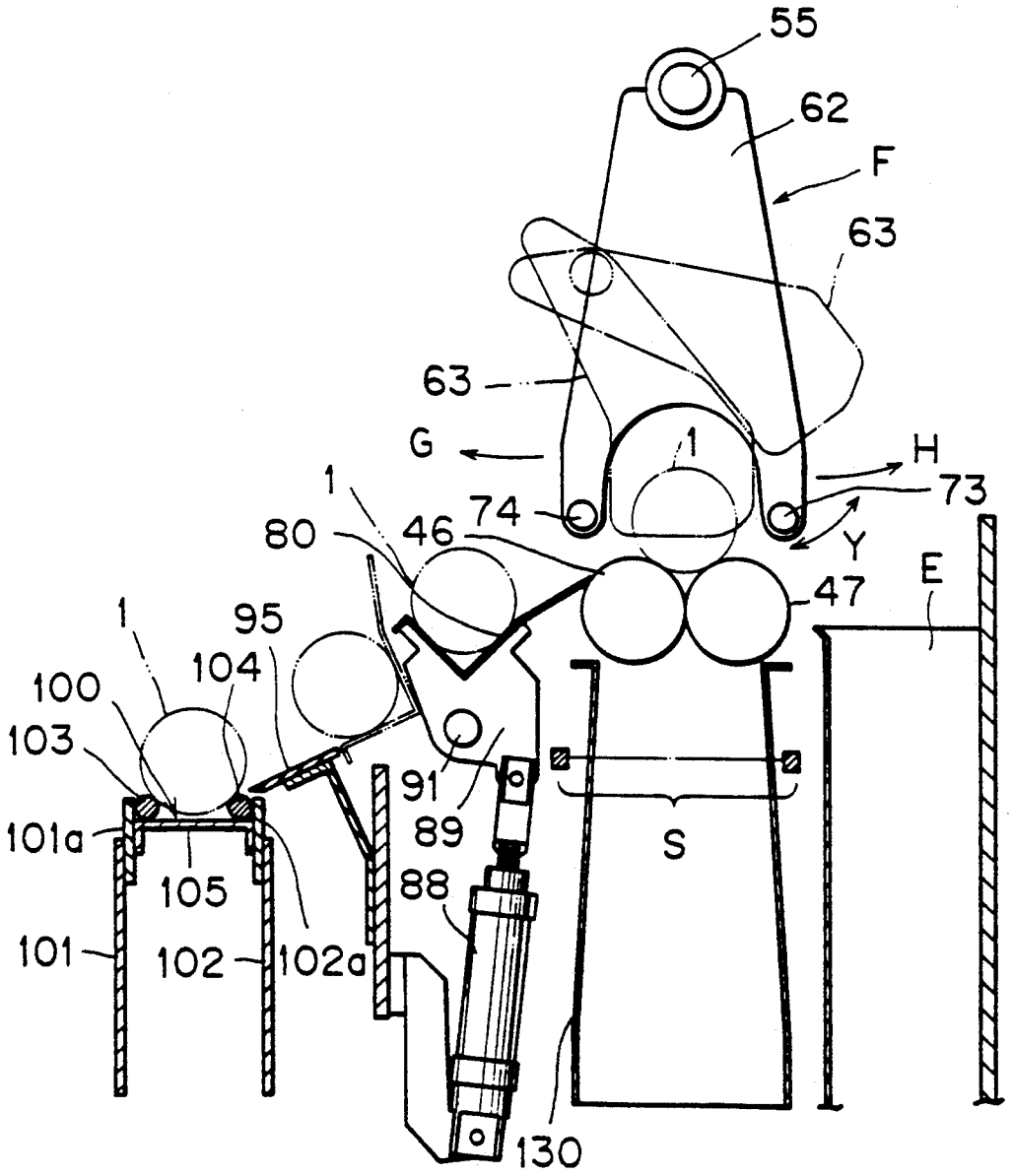
FIG. 13 is a side elevational view of a discharge unit of the apparatus for cutting and removing package material.

As shown in FIG. 13, the shutter plate 63 is angularly movable in the direction indicated by the arrow Y by the air cylinder 59 for selectively opening and closing an inlet opening (described below) through which the packaged object I can be introduced into the package removing unit C. The bracket 60 is movable along the main shaft 55 to vary the horizontal position of the shutter plate 63 (see FIG. 10).

As shown in FIGS. 10 and 13, the inlet opening for introducing the packaged object 1 into the package removing unit C is defined by a bifurcated lower end of a guide plate 62 which is fixed at its upper end to the upstream end of the main shaft 55.

As illustrated in FIG. 12, a swing plate 72 which is of substantially the same shape as the guide plate 62 is fixedly mounted on the downstream end of the main shaft 55. The guide plate 62 and the swing plate 72 are coupled to each other by two connecting rods 73, 74 as shown in FIG. 11. The downstream end of the main shaft 55 is coupled through a link 71 to an air cylinder 70 connected to the frame of the apparatus M. When the air cylinder 70 is actuated, the guide plate 62 and the swing plate 72 are angularly moved in the direction indicated by the arrow G or H in FIGS. 12 and 13.

The connecting rods 73, 74 and the air cylinder 70 jointly serve as a selective discharge mechanism F for discharging the packaged object 1 from the stripper rollers 46, 47.

As illustrated in FIGS. 12 and 13, when the air cylinder 70 is actuated, the swing plate 72 swings in the direction indicated by the arrow G or H, causing the connecting rod 73 or 74 to push the packaged object 1 on the stripper rollers 46, 47 laterally, thereby discharging the packaged object 1.

As shown in FIGS. 10 and 12, a bracket 75 is fixed to a downstream side of the swing plate 72, and a twin-rod air cylinder 76 is fixed to the bracket 75. The air cylinder 76 has two piston rods extending through the swing plate 72, and a support plate 79 for supporting the leading end of the packaged object 1 is fixed to the distal ends of the piston rods of the air cylinder 76. The air cylinder 76 serves to lightly hold the unpackaged object 1 axially together against the danger of getting scattered around after the package material 2 is removed from the packaged abject 1 by the stripper rollers 46, 47.

The unpackaged object 1 in which the package material 2 has been removed by the package removing unit C is discharged onto a tray 80 by the selective discharge mechanism F as shown in FIG. 13. The tray 80 temporarily holds the discharged unpackaged object 1, and then transfers the unpackaged object 1 to a delivery mechanism 100.

As shown in FIG. 13, the tray 80 is of a V-shaped cross section and is connected through a joint 89 to an air cylinder 88 positioned therebelow. The joint 89 is angularly movably mounted on a pin 91. When the air cylinder 88 is actuated to project its piston rod, it angularly moves the joint 89 counterclockwise (FIG. 13) about the pin 91 for turning the tray 80 counterclockwise, thereby transferring the unpackaged object 1 over a cross plate 95 onto the delivery mechanism 100.

The delivery mechanism 100 serves to deliver the unpackaged object I out of the apparatus M in a direction toward the viewer of FIG. 13. The delivery mechanism 100 has a pair of spaced base plates 101, 102 with respective guide plates 101*a*, 102*a* fixed thereto. A bottom plate 105 extends horizontally between and is secured to the guide plates 101*a*, 102*a*. Two endless belts 103, 104 have upper runs (shown in FIG. 13) placed on the upper surface of the bottom plate 105, and are trained around pulleys, one of which can be driven by a motor 110 (FIG. 2) to deliver the unpackaged object I placed on the endless belts 103, 104.

As shown in FIG. 2, an air cylinder 120 is fixed to the base plates 101, 102 upstream of the endless belts 103, 104, and a presser plate 123 is fixed to the piston rod of the air cylinder 120. When the unpackaged object 1 is transferred onto the delivery mechanism 100, the air cylinder 120 is actuated to project the presser plate 123, which press the trailing end of the unpackaged object I to hold the unpackaged object 1 together so that the ends of the unpackaged object 1 will not be loosened apart.

The leading end of the unpackaged object 1 abuts against the trailing end of the previously delivered unpackaged object 1, and these end stacks are closely put together as a group of can ends 3 which are prevented from spreading apart.

As shown in FIGS. 2 and 13, a discharge chute E is disposed alongside of and adjacent to the package removing unit C on one side thereof remote from the delivery mechanism 100. The discharge chute E serves to discharge the packaged object 1 from which the package material 2 has not been removed by the package removing unit C due to a failure.

As shown in FIG. 13, the discharge chute E has its upper end opening near the stripper roller 47 of the package removing unit C. A sensor S, composed of a light-emitting element and a light-detecting element which are spaced apart from each other, is positioned below the stripper rollers 46, 47 for detecting a package material 2 which has been removed by the stripper rollers 46, 47 and drops between the light-emitting and detecting elements of the sensor S into a package box 130. If the sensor S fails to detect a package material 2 upon elapse of a predetermined period of time, then the selective discharge mechanism F is actuated to discharge the packaged object 1 off the stripper rollers 46, 47 into the discharge chute E. More specifically, when no package material is detected by the sensor S within the predetermined period of time, the air cylinder 70 is actuated to turn the swing plate 72 in the direction indicated by the arrow H. The connecting rod 74 now engages and pushes the packaged object 1 off the stripper rollers 46, 47 into the discharge chute E.

Operation of the apparatus M will now be described below. A packaged object (packaged end stack) 1 is supplied from the upstream conveyor to the supply section 4 of the feed unit A, and moved on the guide members 5 by the conveyor. If there is a preceding packaged object 1 present in the standby section 7, then the packaged object 1 supplied onto the guide members 5 is held in the supply section 4 by the stopper mechanism 6. If there is no preceding packaged object 1 in the standby section 7, the stopper mechanism 6 is released to feed the supplied packaged object 1 into the standby section 7. The packaged object 1 is then delivered by the timing belt 8 to the standby position and stays in the standby position.

When the sensor S below the stripper rollers 46, 47 of the package removing unit C detects the package material 2 removed from another object 1, the swing arm 17 of the feed unit A is actuated by the air cylinder 18 to shift the packaged object 1 laterally from the standby section 7 onto the feed section 10.

The air cylinder coupled to the pusher 11 is then actuated to move the pusher 11. The pusher rod 11*a* of the pusher 11 pushes the trailing end of the packaged object 1, which then moves downstream in the direction indicated by the arrow in FIG. 14(*a*).

Figure 14:
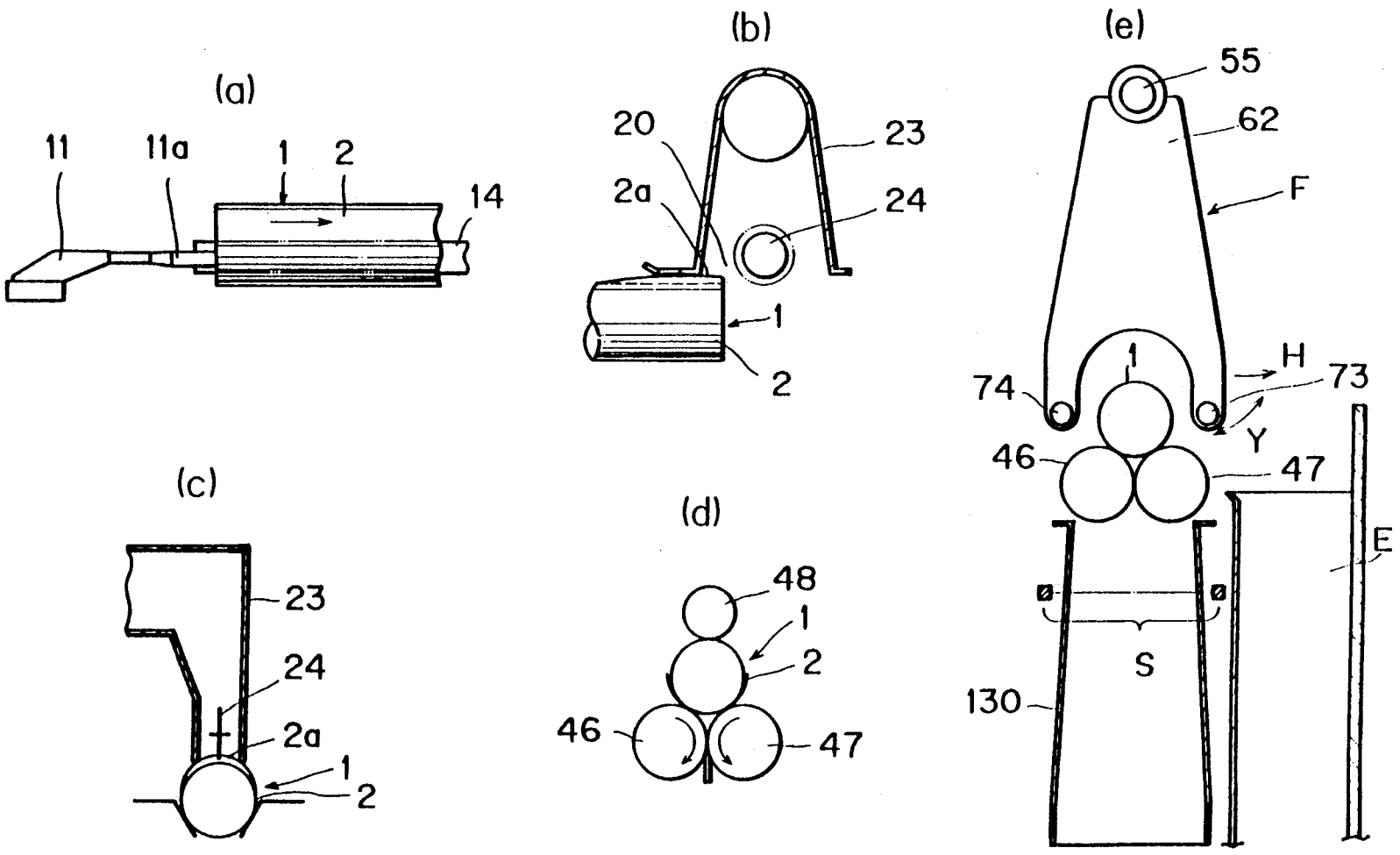
FIGS. 14(*a*) through 14(*e*) are views showing the manner in which the apparatus for cutting and removing package material operates.

When the leading end of the packaged object 1 reaches a position below the suction port 20 of the package cutting unit B, upward suction forces are applied to the packaged object 1 from the vacuum source through the suction duct 23 and the suction port 20. As shown in FIG. 14(*b*), the package material 2 now forms an upwardly slackened portion 2*a* in the upper region of the packaged object 1 under the vacuum created in the suction duct 23. On continued downstream travel of the packaged object 1, the upwardly slackened portion 2*a* is continuously extended in the longitudinal direction of the packaged object 1. At the same time, as shown in FIG. 14(*c*), the upwardly slackened portion 2*a* is continuously cut open in the longitudinal direction by the cutter 24. Debris produced from the package material 2 when the upwardly slackened portion 2*a* is cut open by the cutter 24 is drawn under vacuum into the suction port 20, and hence will not be scattered around and deposited in the package cutting unit B.

After the upwardly slackened portion 2*a* is continuously cut open by the cutter 24, the packaged object 1 is continuously pushed downstream by the pusher 11 onto the stripper rollers 46, 47 of the package removing unit C.

At this time, the shutter plate 63 is angularly moved by the cylinder 59 to open the inlet opening introducing the packaged object 1 into the package removing unit C. After the packaged object 1 has been placed on the stripper rollers 46, 47 while being guided by the guide plate 62, the shutter plate 63 is angularly moved back to close the inlet opening. The air cylinder 76 on the swing plate 72 is then actuated to sandwich the packaged object 1 between the support plate 79 and the shutter plate 63, as shown in FIGS. 10 and 12. Thereafter, the bracket 49 which has been lifted is lowered by the air cylinder 50, forcing the holder rollers 48 to hold the upper surface of the packaged object 1, as shown in FIG. 14(*d*). The packaged object 1 is therefore held down against the stripper rollers 46, 47. The stripper rollers 46, 47 are then rotated in opposite directions to start removing the package material 2 off the packaged object 1. Specifically, the stripper rollers 46, 47 are rotated clockwise and counterclockwise, respectively, in FIG. 14(*d*), frictionally pulling the package material 2 therebetween so as to be removed completely from around the object 1. The removed package material 2 is then discharged from between the stripper rollers 46, 47 downwardly into the package box 130 below the stripper rollers 46, 47.

The object I from which the package material 2 has thus been removed is laterally displaced off the stripper rollers 46, 47 onto the tray 80 by the selective discharge mechanism F which is turned in one direction indicated by the arrow G in FIG. 13.

Thereafter, the tray 80 is turned by the air cylinder 80 to transfer the unpackaged object 1 onto the delivery mechanism 100. The unpackaged object 1 is then delivered by the endless belts 103, 104 to a next processing station such as a seamer (not shown) where can ends 3 are successively seamed on respective cylindrical can bodies.

In synchronism with the arrival of the unpackaged object 1 at the delivery mechanism 100, the cylinder 120 disposed upstream of the endless belts 103, 104 are actuated to cause the presser plate 123 to press the trailing end of the unpackaged object 1, preventing the object (can end stack) 1 from breaking up into individual can ends 3. The leading end of the unpackaged object 1 is held in abutment against the trailing end of the preceding unpackaged object 1. The can ends 3 of the object 1 form a group of successive can ends 3 closely put together.

In the event that the package material 2 cannot be removed from the packaged object 1 by the package removing unit C, the sensor S disposed below the stripper rollers 46, 47 does not detect the package material 2 upon elapse of a predetermined period of time after the start of the stripping process of the package removing unit C. Stated otherwise, the sensor S detects a package cutting open or removal failure, and the selective discharge mechanism F is actuated in the opposite direction indicated by the arrow H, discharging the packaged object 1 into the discharge chute E. Specifically, the air cylinder 70 is actuated to angularly move the swing plate 7 and the guide plate 62 in the direction indicated by the arrow H, causing the connecting rod 74 to push the packaged object 1 off the stripper rollers 46, 47 into the discharge chute E.

Immediately after the packaged object 1 has been discharged into the discharge chute E, a next packaged object 1 located in the standby section 7 of the feed unit A is displaced from the standby position into the feed section 10 by the swing arm 17. The packaged object 1 is then moved through the package cutting unit B by the pusher 11, whereupon the package material 2 thereof is cut open by the cutter 24. Thereafter, the packaged object 1 is fed into the package removing unit C. Consequently, the next packaged object 1 can quickly be supplied to the package removing unit C after the packaged object 1 whose package material has not been removed due to a failure has been discharged from the package removing unit C into the discharge chute E. Then, as described above, the package material 2 of the next packaged object 1 is removed by the package removing unit C, and the unpackaged object 1 is discharged onto the delivery mechanism 100 by the selective discharge mechanism F, and then delivered to the seamer in the manner described above.

As described above, a package cutting open or removal failure is automatically detected by the sensor S, and the packaged object 1 from which the package material 2 cannot be removed because of the package cutting open or removing failure is automatically discharged from the package removing unit C into the discharge chute E. Since the next packaged object 1 is immediately supplied to the package removing unit C after such packaged object I has been discharged into the discharge chute E, the package material 2 of the next packaged object 1 can be cut open and removed without shutting off the apparatus M. Inasmuch as the apparatus M undergoes no shutdown in the event of a package cutting open or removal failure, the next processing station, e.g., a seamer, is not required to be shut off either.

Although a certain preferred embodiment of the present invention has been shown and described in detail, it should be understood that various changes and modifications may be made therein without departing from the scope of the appended claims.

What is claimed is:

1. An apparatus for cutting open and removing a sheet-like package material from an elongated packaged object, the apparatus comprising:

means for feeding the packaged object along a feeding path in a longitudinal direction thereof;

means for creating vacuum condition which is disposed along the packaged object feeding path and provided with a suction opening, said vacuum creating means drawing upwardly the package material of the packaged object to form a loop-like slackened portion of the package material extending in the longitudinal direction of the packaged object;

a cutter disposed in said vacuum creating means near said suction opening and adapted to cut open the slackened portion of the package material;

means for removing the cut-open package material from the packaged object;

means for detecting whether the package material has been removed from the packaged object by said removing means;

means for delivering an unpackaged object from said removing means to a next processing station; and means for discharging the packaged-object from which the package material has not been removed by said removing means as detected by said detecting means.

2. The apparatus according to claim 1, further including:

standby means for keeping the packaged object from feeding until either a preceding unpackaged object or a preceding packaged object is discharged from said removing means.

3. The apparatus according to claim I further including:

a selective discharging means for selectively discharging the unpackaged object from said removing means to said delivery means, and the packaged object from which the package material has not been removed as detected by said detecting means, from said removing means to said discharging means.

4. The apparatus according to claim 1, wherein said feeding means comprises a pusher which pushes an end of the packaged object.

5. The apparatus according to claim 1, wherein said removing means comprises a pair of stripping rollers for frictionally engaging the cut-open package material to remove the package material from the packaged object.

* * * * *